United States Patent [19]

Bilsback et al.

[11] 4,304,450

[45] Dec. 8, 1981

[54] REPAIR OF OPEN CIRCUITED GAS DISCHARGE DISPLAY PANEL CONDUCTORS

[75] Inventors: Malvin S. Bilsback, Woodstock; Michael J. Costa, Poughkeepsie, both of N.Y.

[73] Assignee: International Business Machines Corporation, Armonk, N.Y.

[21] Appl. No.: 104,650

[22] Filed: Dec. 17, 1979

[51] Int. Cl.[3] ..... H01J 9/24; H01J 9/50

[52] U.S. Cl. ..... 316/2; 313/188; 313/331; 228/119

[58] Field of Search ..... 316/2; 313/51, 188, 313/217, 220, 331; 29/850; 228/119

[56] References Cited

U.S. PATENT DOCUMENTS

| | | | |
|---|---|---|---|
| 3,603,836 | 4/1969 | Grier | 313/188 X |
| 3,828,215 | 8/1974 | Bilsback | 313/51 X |
| 3,846,656 | 11/1974 | Schermerhorn | 313/188 |
| 4,039,882 | 8/1977 | Kupsky et al. | 313/217 |

*Primary Examiner*—Howard N. Goldberg
*Assistant Examiner*—K. J. Ramsey
*Attorney, Agent, or Firm*—Mitchell S. Bigel; J. J. Connerton; J. Jancin, Jr.

[57] ABSTRACT

A gas discharge display panel may be used for display purposes despite the presence of open conductors in the panel. Four termination areas, each including a plurality of repair pads are provided, one at each end of each of the two conductor arrays in the panel. One end of each conductor in each array is connected to a respective repair pad in the adjacent termination area. A repair cable having a plurality of conductors runs from the termination area at one end of a conductor array to the termination area at the other end of the array. To repair an open, opposite ends of a respective repair cable conductor are connected to the open conductor's repair pads.

By virtue of the connection of the opposite ends of a repair cable conductor to the open conductor's repair pads, both ends of the open conductor are electrically connected. When an open conductor is energized at one end, the entire body of the open conductor is at the same electrical potential despite the presence of the open. In a preferred embodiment, the repair cable comprises a plurality of conductors partially embedded in a thermosetting adhesive.

41 Claims, 4 Drawing Figures

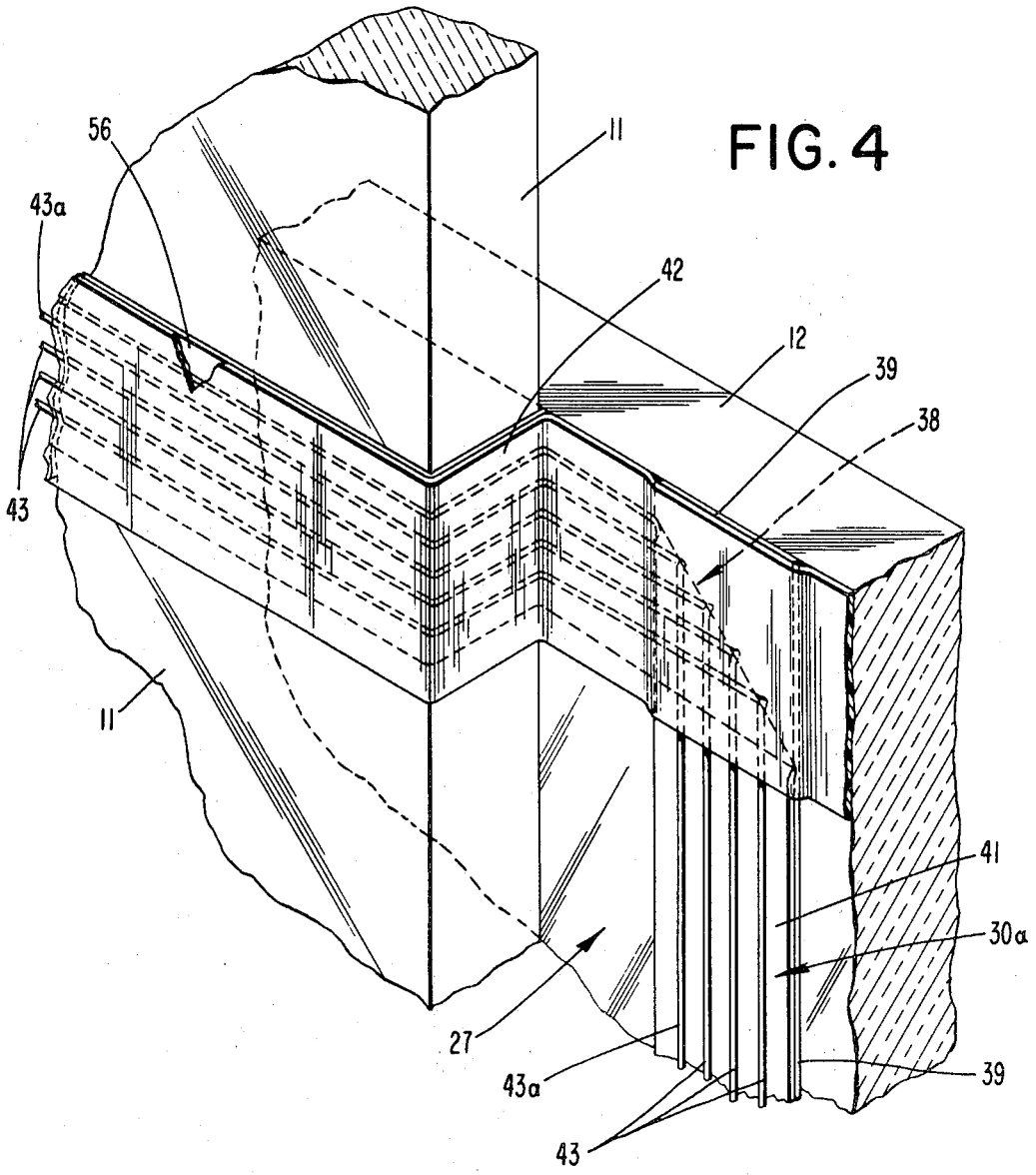
FIG. 4
FIG. 3
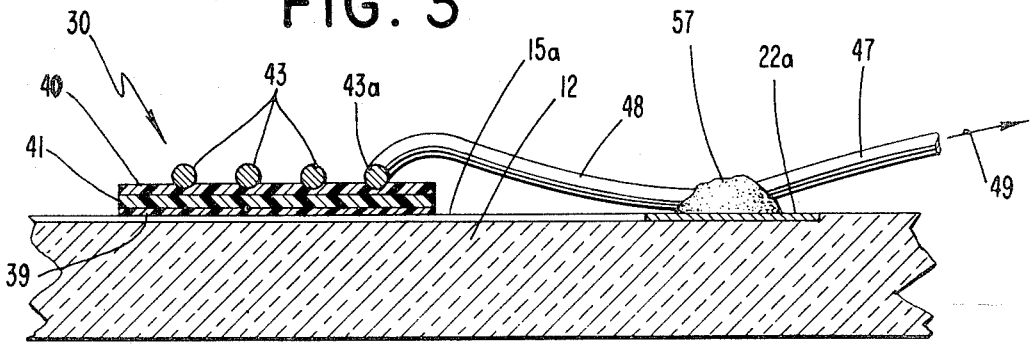

REPAIR OF OPEN CIRCUITED GAS DISCHARGE DISPLAY PANEL CONDUCTORS

DESCRIPTION

Technical Field

This invention generally relates to plasma or gas discharge display panels for displaying information as a sequence of dots or cells, and in particular to a gas discharge display panel which remains operable despite the presence of open circuited conductors in the panel.

Background Art

Gas discharge display panels, hereinafter referred to as gas panels, provide a character and graphic data display capability in data processing and other applications similar to those for which cathode ray tube displays are utilized. A typical gas panel is formed of a pair of closely spaced glass plates, each plate having a parallel array of conductors on the inner surface thereof. Each conductor has an electrical driver connected to one end thereof for the purpose of selectively energizing the associated conductor. Typically the conductor arrays are fabricated on the glass plates using thin or thick film techniques, the two arrays on the pair of glass plates being generally perpendicular to one another. The image area between the two plates is sealed, and filled with an ionizable gaseous medium. For additional details relating to gas panel fabrication, reference is made to U.S. Pat. No. 3,837,724 filed by Peter H. Haberland et al.

The basic operation of a gas display panel is as follows: A conductor may be selectively energized by a driver connected to one end of the conductor. Energization of selected pairs of conductors in each of the two arrays causes breakdown of the gaseous medium at the intersection of the pairs of energized conductors. This gaseous breakdown causes a visible dot display to be formed. A plurality of such visible dots causes a dot matrix display to appear on the glass plates.

During the fabrication of large gas panels, particularly high resolution panels having large numbers of conductors in each array, open circuits may occur in one or more of the conductors due to a conductor break. Open conductors may arise when the conductor arrays are formed on the glass plates, or when the gas panel is assembled. Because a conductor is energized at one end by its associated driver, only that part of the conductor from the driver to the open will be energized. The remainder of the conductor beyond the open will not be energized. It is apparent that such a gas panel requires repair for proper use.

As the resolution of gas panels increases, the number of conductors in an array increase and the cross section of each conductor decreases. Since the probability of open conductors increases as a function of resolution, it is desirable to be able to utilize such panels without any apparent disfunction despite the presence of open conductors thereon. The ability to repair open gas panel conductors results in an overall cost savings by eliminating gas panel discards, and an increase in the level of gas panel performance.

One way of using a gas panel for alphanumeric display despite the presence of open conductors thereon is disclosed in Application Ser. No. 125,616, filed on Feb. 28, 1980, which is a continuation of Application Ser. No. 948,125 filed by J. L. Kehoe on Oct. 3, 1978, and assigned to the assignee of the present invention. In that application, additional conductor lines are added to the conductor arrays in the gas panel, and the display is shifted horizontally or vertically to utilize the extra conductor lines for display, while the defective conductor lines are located in the nondisplay area.

DISCLOSURE OF INVENTION

It is an object of this invention to provide an improved gas panel assembly.

It is another object of the invention to provide a gas panel which may be used without apparent defect despite the presence of one or more open conductors in the panel.

It is still another object of the invention to provide a gas panel wherein open conductors thereon may be used for display purposes.

These and other objects are attained by providing a gas panel assembly having the following characteristics:

1. Each end of the conductor arrays is provided with a termination area, for a total of four termination areas per panel.

2. Respective ends of each conductor in the two arrays extend into the adjacent termination area. Thus for each array the conductors therein extend into the termination areas at opposite ends of the array.

3. One or more multiconductor repair cables are provided for each array to be repaired. The repair cable runs from the termination area at one end of the array to the termination area at the opposite end of the array.

4. For each open conductor in the array, a repair cable conductor is connected to opposite ends of the open conductor in the termination areas at opposite ends of the array. By virtue of the connection of the open conductor to a repair cable conductor in the termination areas at both ends of the array, both ends of the open conductor are electrically connected. When thus connected, energization of one end of the open conductor by its associated driver energizes the opposite end of the open conductor as well. Since both ends of the conductor are energized, the entire conductor is energized despite the open. All parts of the open conductor may be utilized for display purposes, not merely that part from the driver to the open.

In one embodiment of the invention, each termination area is provided with a plurality of repair pads connected to respective ones of the array conductors. Opposite ends of the repair cable conductors are then connected to the open conductors' associated repair pads.

In a preferred embodiment, the repair cable comprises a plurality (e.g., four) of conductors partially embedded within a thermosetting adhesive. The ends of repair cable conductors may be peeled from the repair cable and connected to the open conductor's repair pads. Two repair cables are used per array to maximize the number of open conductors which may be repaired.

BRIEF DESCRIPTION OF THE DRAWINGS

FIG. 3 is a cross section of the repair cable of FIG. 2.

FIG. 4 is a detailed perspective representation of the upper right hand corner of the gas panel assembly of FIG. 2.

BEST MODE FOR CARRYING OUT THE INVENTION

Gas Panel Construction

Figure 1:
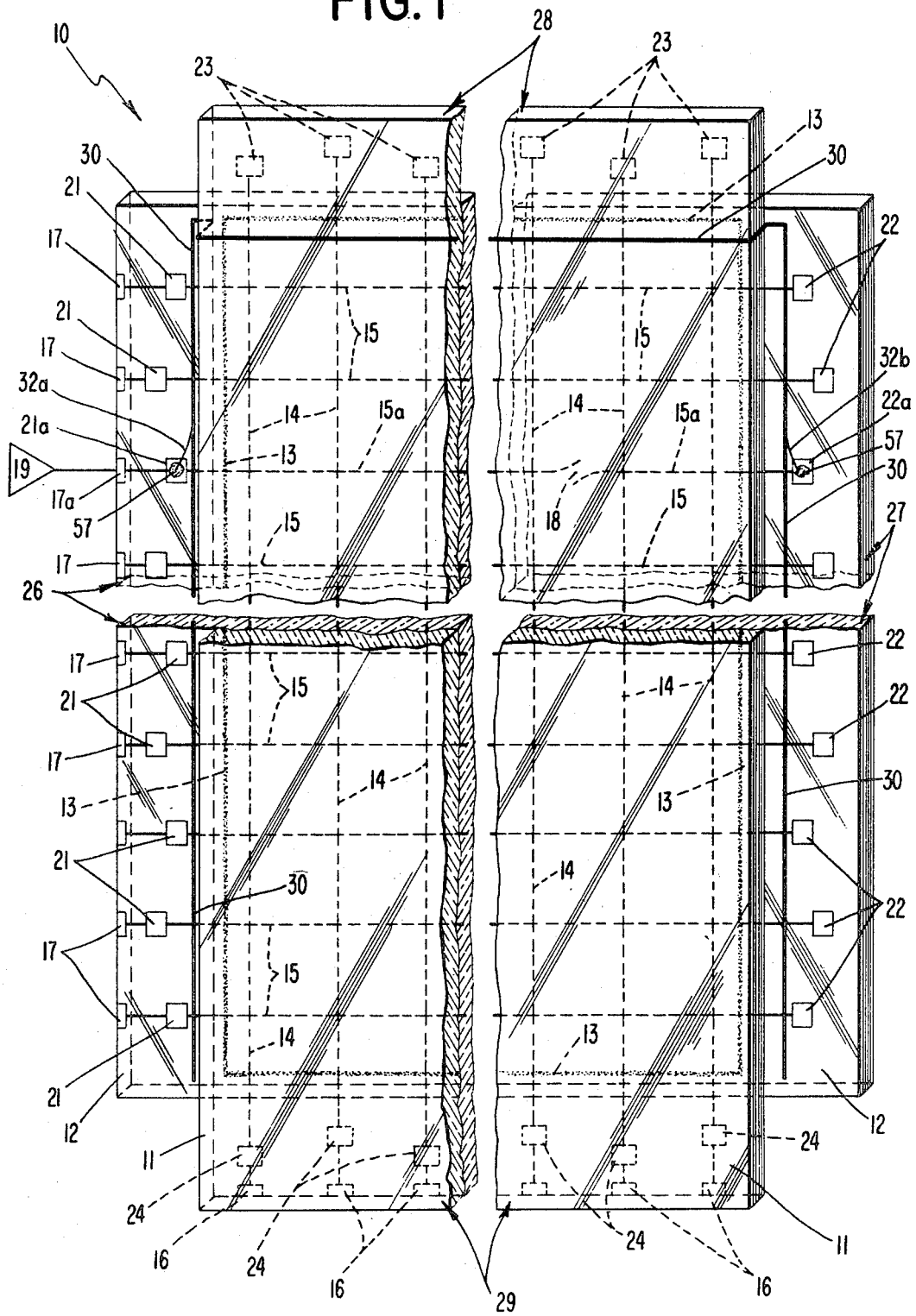
FIG. 1 is a perspective representation of a gas panel assembly employing a first embodiment of the invention for repair of open conductors.

Referring now to the drawings, FIG. 1 illustrates a gas panel assembly 10. The panel comprises first and second closely spaced rectangular glass plates 11 and 12, respectively. Seal 13 defines an enclosed volume within the area of overlap of the plates, into which volume is pumped a gas or mixture of gases conducive to gas discharge.

On the inner surface of each of plates 11 and 12 (i.e., the two surfaces of the plates that are adjacent one another), an array of parallel conductors 14 and 15, respectively, is formed. Reference numerals 14 and 15 refer to the individual conductors in the arrays and thereby designate the respective arrays which comprise the individual conductors. The conductors are parallel to the long side of their associated plate. On plate 11, conductors 14 are vertical. On plate 12, conductors 15 are horizontal. The conductor arrays are formed on the inner surfaces of plates 11 and 12 by any suitable practice including thick or thin film deposition techniques.

Figure 2:
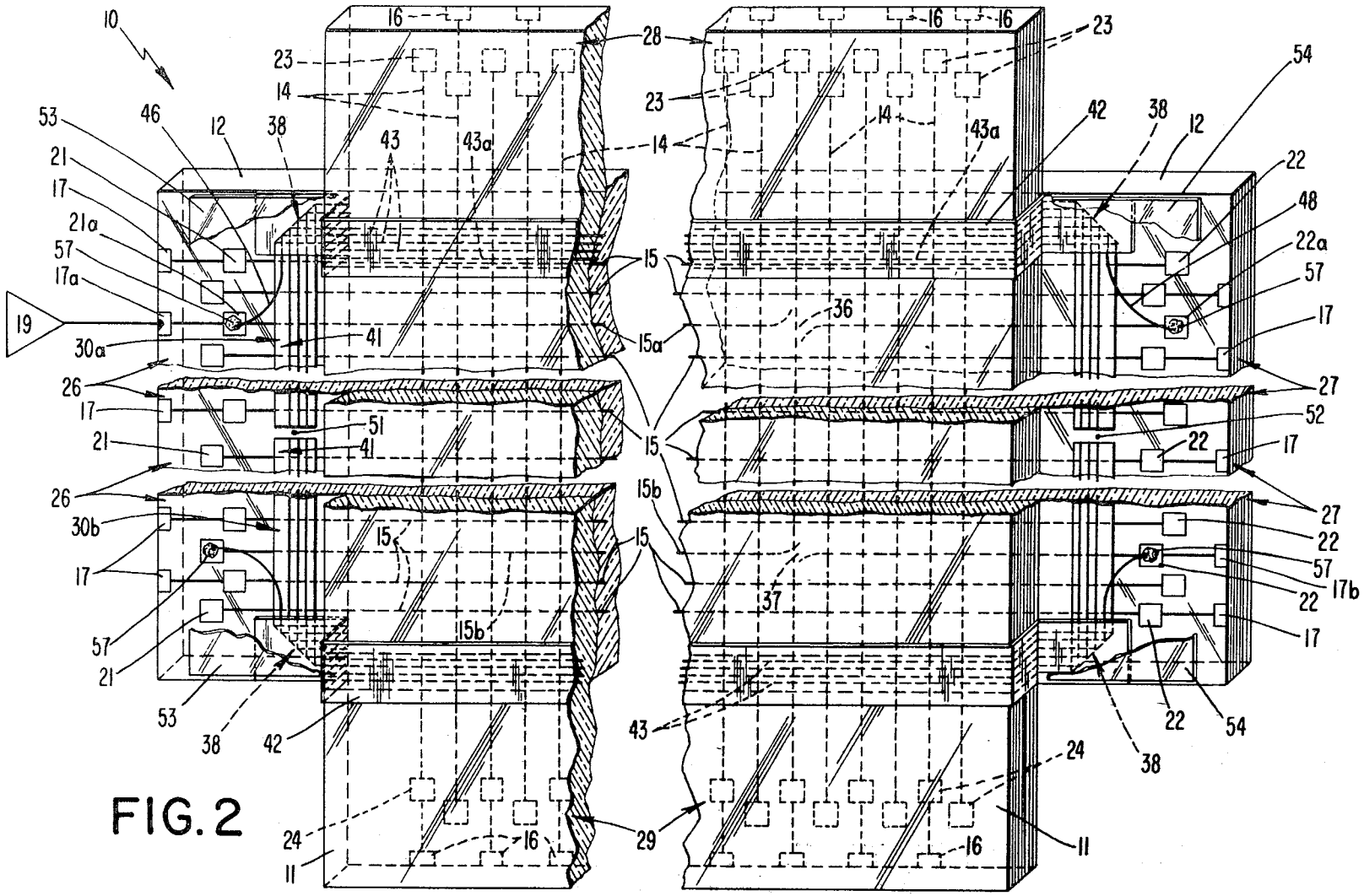
FIG. 2 is a perspective representation of a gas panel assembly employing a preferred embodiment of the invention.

Each vertical conductor is separately energized by an associated driver connected to the conductors 14 at driver pads 16, while each horizontal conductor is separately energized by an associated driver connected to the conductors 15 at driver pads 17. For the sake of clarity only one driver 19 is shown connected to driver pad 17*a* although in practice, a single driver per conductor is utilized. In FIG. 1, driver pads 16 are all on the bottom of array 14 and driver pads 17 are all at the left end of array 15. The driver pads may also alternate between the top and bottom of plate 11 and the left and right of plate 12 to promote denser packaging, as is shown in FIG. 2. However, it is to be noted that in either embodiment, each conductor is energized at one end only. An energization voltage impressed by a driver at a driver pad will exist along the entire length of its associated conductor.

Gas Panel Operation

Operation of a typical gas panel to display a particular point or cell on the panel is as follows: An appropriate horizontal conductor 15 and vertical conductor 14 are selectively energized such that their intersection is at the point or cell at which a dot is to be displayed. Energization of the associated horizontal and vertical conductors causes the gas to discharge at the points of intersection of the conductors. Driver circuitry can simultaneously energize any combination of horizontal and vertical conductors to display any desired combination of points to form dot matrix characters or other recognizable patterns. For additional details relating to gas panel operation, reference is made to U.S. Pat. No. 3,973,253 to Criscimagna et al.

The operation of a gas panel with an open conductor is as follows: Still referring to FIG. 1, an open 18 is shown in horizontal conductor 15*a*. The driver pad 17*a* for the open conductor 15*a* is on the left end of plate 12. When driver pad 17*a* is energized, the energization voltage only appears on conductor 15*a* between driver pad 17*a* and open 18. The remainder of the conductor to the right of open 18 is not energized. Consequently, no cell to the right of open 18 on conductor 15*a* may be selected for display, and the gas panel must either be discarded, or used with an apparent visible defect.

First Embodiment of the Invention

In order to repair open conductors, repair pads are connected to both ends of each conductor. In FIG. 1, plate 12 contains a plurality of repair pads 21 in termination area 26, and a plurality of repair pads 22 in termination area 27. Plate 11 contains a plurality of repair pads 23 in termination area 28, and a plurality of repair pads 24 in termination area 29. The repair pads are arranged generally in linear fashion, although they may be slightly staggered for denser packaging as shown in FIG. 1. One end of each of the conductors in horizontal array 15 is connected to a respective repair pad 21 in termination area 26, whereas the opposite end of each of the conductors in array 15 is connected to a respective repair pad 22 in termination area 27. Correspondingly similar connections are made to conductors in array 14 and repair pads 23 and 24, in termination areas 28 and 29, respectively. It is understood that the term "end", as herein employed, with regard to the array conductors, does not designate the extremity of an array conductor, but rather any point on an array conductor within the termination area.

Repair cable 30 comprising a plurality of repair cable conductors, is shown for repairing open conductors in array 15. For the sake of clarity, a repair cable for repairing open conductors in array 14 is not shown. However, it will be understood that the repair of open conductors in array 14 proceeds in an analogous manner with the procedure outlined below for array 15. Repair cable 30 is strung along the length of termination area 26, across the outer surface of plate 11 and then along the length of termination area 27.

By way of example, the repair of open 18 by means of repair cable 30 will be illustrated. Prior to the repair, all the conductors of gas panel 10 are checked for continuity in order to identify and locate all open conductors. Continuity checks may be conducted by simultaneously driving every conductor in the panel and observing those conductors where gas discharge does not occur, or by inserting each conductor in a circuit having a bell, or light, and noting for which conductors the bell or light is inoperative, or by other conventional methods. For the sake of the illustration below, it is assumed that open conductor 15*a* has been identified.

In termination area 26, one end 32*a*, of one of the conductors of repair cable 30 is connected to the repair pad 21*a*, to which one end of conductor 15*a* is connected. In termination area 27, the other end 32*b* of this same repair cable conductor is connected to the repair pad 22*a*, to which the opposite end of the conductor 15*a* is connected. It is understood that the term "end" as herein employed, with regard to the repair cable conductors, does not designate the extremity of a repair cable conductor, but rather any point on a repair cable conductor within the termination area.

By virtue of the connection of both sides of the open conductor 15*a* to a repair cable conductor, the open conductor has been effectively repaired. When driver pad 17*a* is energized, the energization voltage appears on conductor 15*a* between driver pad 17*a* and open 18 as previously described. Since the energization voltage appears at both ends 32*a* and 32*b* of the connected repair cable conductor, the energization voltage also appears on conductor 15*a* between repair pad 22*a* and open 18.

Because of the connection of respective ends 32*a* and 32*b* of a repair cable conductor to respective repair pads 21*a* and 22*a* in termination areas 26 and 27, the entire body of open conductor 15*a*, both to the left and right of the open 18, is electrically connected, and will always be at the same electrical potential. All points on conductor 15*a* may now be utilized for display purposes.

It will be realized that area 18 itself will not be at the energization voltage. However, the size of open 18 will be minute compared to the conductor length, and lack of energization at this minute point is beyond the resolution capability of the viewer's eye. The gas panel is therefore usable without apparent defect.

It will be understood by those skilled in the art that the first embodiment of the invention has been described with regard to a single open 18 in horizontal array 15. However, repair cable 30 includes a plurality of conductors, so that a plurality of opens in array 15 may be repaired by utilizing one repair cable conductor for each open. If there are more opens than there are repair cable conductors, a second repair cable may be added. Alternatively, repair cable 30 may be a single repair cable conductor. Repair of a plurality of opens will then require a like plurality of repair cables.

Repair of open conductors in array 14 may be effected by means of a repair cable running from termination area 28, along the left or right side of plate 12 to termination area 29. Any number of opens in both arrays may thus be repaired. It will be understood that arrays 14 and 15 need not be horizontal and vertical, respectively but may be arranged in any manner such that their intersection defines a grid of display cells.

Preferred Embodiment of the Invention

FIG. 2 illustrates the preferred embodiment of the invention. As in FIG. 1, plates 11 and 12 each have an array of parallel conductors on the inner surface thereof. For the sake of clarity seal 13 is not shown. Driver pads 17 for array 15 are alternated between the left and right ends of plate 12 to promote greater packing density. As noted with regard to FIG. 1, each conductor is energized by a driver at one end only.

In FIG. 2, two opens 36 and 37 are shown on conductors 15*a* and 15*b*, respectively. It is assumed that these opens have been located in the manner described with respect to the First Embodiment of the Invention. When driver pad 17*a* is energized by its associated driver 19, the energization voltage only appears on conductor 15*a* between driver pad 17*a* and open 36. The remainder of conductor 15*a* to the right of open 36 is not energized. When driver pad 17*b* is energized, the energization voltage only appears on conductor 15*b* between driver pad 17*b* and open 37. The remainder of conductor 15*b* to the left of open 37 is not energized.

In order to render the gas panel usable despite the presence of opens, repair pads are connected to both ends of each conductor. A plurality of repair pads 21 are contained in termination area 26, on the inner surface of plate 12 outside the display area of the plates. A plurality of repair pads 22 are contained in termination area 27, on the inner surface of plate 12 outside the display area of the plates. Similarly a plurality of repair pads 23 and 24 are contained in termination areas 28 and 29, respectively, of plate 11. Repair pads 21, 22, 23 and 24 are arranged in a generally linear fashion, although they are staggered to permit denser packaging. One end of each of the conductors in array 15 is connected to a respective repair pad 21, in termination area 26. The opposite end of each of the conductors in array 15 is connected to a respective repair pad 22, in termination area 27. Like connections are made for array 14.

In the preferred embodiment of the invention shown in FIG. 2, first and second repair cables 30*a* and 30*b*, respectively, are used to repair open conductors in horizontal array 15. The cross section of repair cables 30*a* and 30*b* is illustrated in FIG. 3. Referring briefly to FIG. 3, each cable comprises a polyester base material 41, and a layer of thermosetting adhesive 40 into which are partially embedded a plurality of repair cable conductors 43 of polyurethene insulated wire. In FIG. 3, one of the repair cable conductors 43 is shown peeled off from base 41 and connected to a repair pad 21 as will be described below. Double sided adhesive tape 39 attaches the repair cable to plate 12, as will be described below. Referring back to FIG. 2, first repair caboe 30*a* is strung from point 51 in termination area 26, to the top of temination area 26, is bent at a right angle and crosses onto the outer surface of plate 11. It is strung across the outer surface of plate 11 to the top of termination area 27, is again bent at a right angle, and strung to point 52 in termination area 27.

Second repair cable 30*b* is strung from point 51 in termination area 26, to the bottom of termination area 26, is bent at a right angle and crosses onto the outer surface of plate 11. It is strung across the outer surface of plate 11 to the bottom end of termination are a 27, is again bent at a right angle and strung to point 52 in termination area 27.

The use of two repair cables 30*a* and 30*b* for plate 12 effectively doubles the number of open conductors that may be repaired. In the preferred embodiment of FIG. 2, repair cable 30*a* may be used to repair four horizontal opens in the upper part of array 15, whereas repair cable 30*b* may be used to repair four horizontal opens in the lower part of array 15. Thus, although the repair cables are only four conductors wide, eight opens in horizontal array 15 may be repaired. It will be noted that points 51 and 52 in termination areas 26 and 27, respectively, are reference points to designate the end points of the repair cable and need not be at the geometrical center of the respective termination areas. The cables may begin and end at any point in the termination area depending upon the number and locations of the open conductors.

FIG. 4 illustrates in detail the upper right hand corner of the gas panel of FIG. 2. In termination area 27, base material 41 of repair cable 30*a* faces plate 12, while repair cable conductors 43 face outward and are exposed. After right angle bend shown at 38, repair cable conductors 43 face plate 11, and base material 41 faces outward. A like arrangement is utilized at all four corners of the gas panel so that repair cable conductors 43 are exposed throughout the length of termination areas 26 and 27.

In the Preferred Embodiment of the Invention, repair cable 30*a* is attached to termination area 27 by double sided adhesive carrier tape 39 placed between repair cable 30*a* and termination area 27. This is effected by mounting a strip of double sided carrier tape 39 along termination area 27 and then laying repair cable 30*a* on carrier tape 39. Where repair cable 30*b* extends across plate 11, double sided adhesive foam tape 56 is interposed between repair cable 30*a* and plate 11. This is effected by mounting a strip of double sided adhesive foam tape 56 along plate 11, between the top of termination areas 26 and 27, and then laying repair cable 30*a* on foam tape 56. Double sided adhesive foam tape 56 attaches repair cable 30*a* to plate 11, and acts as a cushion for repair cable 30*a* to prevent harm to the cable where it extends along plate 11. On plate 11, sealing tape 42 is then mounted over repair cable 30*a* and foam tape 56, to protect the repair cable. It is to be noted that in termination areas 26 and 27, the repair cable conductors are exposed and unprotected.

Repair of an open using the preferred embodiment of the invention will now be described with respect to open 36 in conductor 15*a* of FIG. 2. Repair cable conductor 43*a* in repair cable 30*a* is used to effect the repair. That portion 48, of repair cable conductor 43*a* in termination area 27, is peeled off from thermosetting adhesive 40 by tweezers or other conventional means. Portion 48 of repair conductor 43*a* is positioned over repair pad 22*a* to which conductor 15*a* is connected, as illustrated in FIG. 3.

Because the repair cable conductors are polyurethene insulated wire, it is possible to solder through the insulation without first cutting the wire to length. Portion 48 of repair cable conductor 43*a* is positioned over repair pad 22*a*. A small solder ball is then placed on top of repair pad 22*a*. Portion 48 of repair cable conductor 43*a* is then soldered to repair pad 22*a*. The solder joint is indicated by 57. That part of the repair cable conductor from repair pad 22*a* to tip 47 is then pulled in the direction of arrow 49 to remove the excess repair cable conductor. Pulling to remove the excess conductor also serves to test the strength of solder joint 57. After portion 48 is peeled away, soldered, and the excess removed, the appearance is as shown in FIG. 2.

A similar process is performed at the other end 46 of repair cable conductor 43*a* in termination area 26, and for all other open conductors in array 15. After all repairs have been completed, sealing tapes 53 and 54, portions of which are shown in FIG. 2, are placed over the repair cable and repair pads in termination areas 26 and 27 respectively, to protect the exposed repair cable conductors and repair pads.

Because both ends of open conductor 15*a* are connected to repair cable conductor 43*a*, conductor 15*a* is now usable throughout its length. When repair pad 17*a* is energized by driver 19, the energization voltage appears on conductor 15*a* between driver pad 17*a* and open 36. The energization voltage appears on repair cable conductor 43*a* and therefore on the conductor 15*a* between driver pad 17*b* and open 36. The two ends of the conductor 15*a* are electrically connected by repair cable conductor 43*a*, so that the entire body of the conductor 15*a* both to the left and to the right of open 36 is always at the same electrical potential. All points on the conductor may be utilized for display purposes despite the presence of the open. The open area itself will not be energized. However the lack of energization at this minute point is beyond the resolution capability of the viewer's eye, as previously discussed.

It will be understood by those skilled in the art that a repair cable or cables may be utilized to repair open conductors in plate 11. If there are more than eight open conductors per plate, repair cables having more than four conductors per cable may be used. Alternatively, more than two repair cables per plate may be used.

While the invention has been particularly shown and described with reference to a preferred embodiment thereof, it will be understood by those skilled in the art that the foregoing and other changes in form and details may be made therein without departing from the spirit and scope of the invention.

We claim:

1. In a gas discharge display panel assembly having first and second closely spaced plates, an ionizable gas medium confined in a sealed area therebetween, and first and second arrays of parallel conductors arranged on said first and said second plates, respectively, apparatus for repairing open conductors in said first array comprising:

first and second termination areas for said first array, one end of the conductors in said first array extending into said first termination area, and the opposite end of the conductors in said first array extending into said second termination area, a repair cable having a plurality of repair cable conductors extending between said first and said second termination areas, and means connecting corresponding repair cable conductors to opposite ends of said open conductors in said first and second termination areas, whereby the entire body of each of said open conductors is maintained at the same electrical potential.

2. In a gas discharge display panel assembly having first and second closely spaced plates, an ionizable gas medium confined in a sealed area therebetween, and first and second arrays of parallel conductors arranged on said first and said second plates, respectively, apparatus for repairing an open conductor in said first array comprising:

first and second termination areas for said first array, each termination area including a plurality of repair pads, one end of each of said parallel conductors in said first array being connected to respective ones of said repair pads in said first termination area, and the opposite end of each of said parallel conductors in said first array being connected to respective ones of said repair pads in said second termination area, a repair cable conductor extending between said first and said second termination areas, and means connecting said repair cable conductor to the repair pads in said first and said second termination areas, to which said open conductor is connected, whereby the entire body of said open conductor is maintained at the same electrical potential.

3. The gas discharge display panel assembly of claim 2 wherein said repair cable is supported by said second plate, and further comprising double sided adhesive tape between said repair cable and said second plate for holding said repair cable against said second plate.

4. The gas discharge display panel assembly of claim 3 wherein said double sided adhesive tape is foam tape, for cushioning said repair cable as it is held against said second plate.

5. The gas discharge display panel assembly of claim 2 further comprising a sealing tape covering said repair cable and said repair pads, in said first and second termination areas.

6. The gas discharge display panel assembly of claim 2 wherein said first termination area further includes a plurality of driver pads, one end of each of said parallel conductors in said first array being connected to respective ones of said driver pads.

7. The gas discharge display panel assembly of claim 2 wherein said repair cable comprises a polyester base, a layer of thermosetting adhesive on said base and a repair cable conductor partially embedded within said layer of thermosetting adhesive.

8. The gas discharge display panel assembly of claim 7 wherein said repair cable conductors comprise polyurethane insulated wires.

9. In a gas discharge display panel assembly having first and second closely spaced plates, an ionizable gas medium confined in a sealed area therebetween, and first and second arrays of parallel conductors arranged on said first and second plates, respectively, said arrays being disposed substantially orthogonal to each other, and the respective intersection of pairs of orthogonal conductors defining gaseous discharge cells, apparatus for repairing open conductors in said first array comprising:

first and second termination areas for said first array, each termination area including a plurality of linearly arranged repair pads, one end of each of said parallel conductors in said first array being connected to respectives ones of said repair pads in said first termination area, and the opposite end of each of said parallel conductors in said first array being connected to respective ones of said repair pads in said second termination area, a first repair cable having a plurality of first repair cable conductors, extending from a point in said first termination area to one end of said first termination area, across said second plate on the outer surface thereof, to one end of said second termination area and to a point in said second termination area, means connecting corresponding first repair cable conductors in said first termination area to respective repair pads associated with said one end of said open conductors between said point and said one end of said first termination area, and means connecting corresponding first repair cable conductors in said second termination area to respective repair pads associated with said opposite end of said open conductors between said point and said one end of said second termination area, whereby the entire body of each of said open conductors between said point and said one end of said first termination area is maintained at the same electrical potential.

10. The gas discharge display panel assembly of claim 9 further comprising:

a second repair cable having a plurality of second repair cable conductors extending from said point in said first termination area to the other end of said first termination area, across said second plate on the outer surface thereof to the other end of said second termination area and to said point in said second termination area, means connecting corresponding second repair cable conductors in said first termination area to respective repair pads associated with said one end of said open conductors between said point and said other end of said first termination area, and means connecting corresponding second repair cable conductors in said second termination area to respective repair pads associated with said opposite end of said open conductors between said point and said other end of said second termination area, whereby the entire body of each of said open conductors between said point and said other end of said first termination area is maintained at the same electrical potential.

11. The gas discharge display panel assembly of claim 9 further comprising double sided adhesive tape between said first repair cable and said outer surface of said second plate, for holding said first repair cable against the outer surface of said second plate.

12. The gas discharge display panel assembly of claim 11 wherein said double sided adhesive tape is foam tape, for cushioning said first repair cable as it is held against the outer surface of said second plate.

13. The gas discharge display panel assembly of claim 9 further comprising a sealing tape covering said first repair cable and said repair pads, in said first and second termination areas.

14. The gas discharge display panel assembly of claim 9 wherein said first termination area further includes a plurality of driver pads, said one end of some of said parallel conductors in said first array being connected to respective ones of said driver pads in said first termination area, and said second termination area further includes a plurality of driver pads, said opposite end of the remainder of said parallel conductors in said first array being connected to respective ones of said driver pads in said second termination area.

15. The gas discharge display panel assembly of claim 9 wherein said first repair cable comprises a polyester base, a layer of thermosetting adhesive on said base and a plurality of first repair cable conductors partially embedded within said layer of thermosetting adhesive.

16. The gas discharge display panel assembly of claim 15 wherein said first repair cable conductors comprise polyurethene insulated wires.

17. A method for repairing an open conductor in the first array of a gas discharge display panel assembly having first and second closely spaced plates, an ionizable gas medium confined in a sealed area therebetween, first and second arrays of parallel conductors arranged on said first and second plates, respectively, said arrays being disposed substantially orthogonal to each other, the respective intersection of pairs of orthogonal conductors defining gaseous discharge cells, first and second termination areas for said first array, each termination area including a plurality of repair pads, one end of each of said parallel conductors in said first array being connected to respective ones of said repair pads in said first termination area and the opposite end of each of said parallel conductors in said first array being connected to respective ones of said repair pads in said second termination area, said method for repairing an open conductor in said first array comprising the steps of:

(A) mounting a repair cable, having a repair cable conductor, on said gas discharge display panel assembly, between said first termination area and said second termination area, (B) connecting one end of said repair cable conductor to the repair pad associated with one end of said open conductor in said first termination area, and (C) connecting the other end of said repair cable conductor to the repair pad associated with the opposite end of said open conductor in said second termination area.

18. The method of claim 17 additionally comprising a step to locate the open conductor in said first array by checking the continuity of each of said conductors in said first array, prior to connecting the repair cable conductor to repair pads.

19. A method for repairing open conductors in the first array of a gas discharge display panel assembly having first and second closely spaced plates, an ionizable gas medium confined in a sealed gas area therebetween, first and second arrays of parallel conductors arranged on said first and second plates, respectively, said arrays being disposed substantially orthogonal to each other, the respective intersection of pairs of orthogonal conductors defining gaseous discharge cells, first and second termination areas for said first array, each termination area including a plurality of repair pads, one end of each of said parallel conductors in said first array being connected to respective ones of said repair pads in said first termination area, and the opposite end of each of said parallel conductors in said first array being connected to respective ones of said repair pads in said second termination area, said method for repairing open conductors in said first array comprising the steps of:

(A) stringing a first repair cable, having a plurality of first repair cable conductors, from a point in said first termination area to one end of said first termination area, (B) right angle bending said first repair cable at said one end of said termination area, (C) stringing said first repair cable from said one end of said first termination area, across said second plate on the outer surface thereof, and to one end of said second termination area, (D) right angle bending said first repair cable at one end of said second termination area, (E) stringing said first repair cable from said one end of said second termination area to a point in said second termination area, (F) connecting one end of corresponding first repair cable conductors to the respective repair pads associated with open conductors between said point and said one end of said first termination area, and (G) connecting the other end of corresponding first repair cable conductors to the respective repair pads associated with open conductors between said point and said one end of said second termination area.

20. The method of claim 19 additionally comprising a step to locate open conductors in said first array by checking the continuity of each of said conductors in said first array, prior to connecting repair cable conductors to repair pads.

21. The method of claim 19 wherein stringing step C further includes attaching double sided adhesive foam tape across said second plate on the outer surface thereof, and mounting said first repair cable on said double sided adhesive foam tape.

22. The method of claim 19 wherein stringing step A further includes attaching double sided adhesive tape from said point to said one end of said first termination area, and mounting said first repair cable on said double sided adhesive tape.

23. The method of claim 19 wherein stringing step E further includes attaching double sided adhesive tape from said one end to said point in said second termination area, and mounting said first repair cable on said double sided adhesive tape.

24. The method of claim 19 further comprising the step of mounting a sealing tape in said first termination area over the repair pads and the first repair cable.

25. The method of claim 19 further comprising the step mounting a sealing tape in said second termination area over the repair pads and the first repair cable.

26. The method of claim 19 wherein said repair cable comprises a polyester base, a layer of thermosetting adhesive on said base and a plurality of repair cable conductors, comprising polyurethane insulated wires, partially embedded within said layer of thermosetting adhesive, and wherein said connecting step F comprises the substeps of:

(F1) peeling off one end of corresponding first repair cable conductors from said layer of thermosetting adhesive, (F2) positioning a portion of respective ones of peeled off first repair cable conductors over the repair pads associated with said open conductors between said point and said one end of said first termination area, (F3) placing a solder ball on each of the repair pads associated with said open conductors between said point and said one end of said first termination area, (F4) soldering said portions of peeled off first repair cable conductors to said repair pads, and (F5) pulling the respective tips of the soldered first repair cable conductors to break off the soldered first repair cable conductors from the soldered portions to the tips.

27. The method of claim 19 wherein said connecting step G comprises the substeps of:

(G1) peeling off the other end of corresponding first repair cable conductors from said layer of thermosetting adhesive, (G2) positioning a portion of respective ones of peeled off first repair cable conductors over the repair pads associated with said open conductors between said point and said one end of said second termination area, (G3) placing a solder ball on each of the repair pads associated with said open conductors between said point and said one end of said second termination area, (G4) soldering said portions of peeled off first repair cable conductors to said repair pads, and (G5) pulling the respective tips of the soldered first repair cable conductors to break off the soldered first repair cable conductors from the soldered portions to the tips.

28. In a gas discharge display panel assembly having first and second closely spaced plates, an ionizable gas medium confined in a sealed area therebetween, and first and second arrays of parallel conductors arranged on said first and said second plates, respectively, apparatus for repairing open conductors in said first array comprising:

first and second termination areas for said first array, one end of the conductors in said first array extending into said first termination area, and the opposite end of the conductors in said first array extending into said second termination area, a repair cable having a plurality of repair cable conductors extending between said first and said second termination areas, and means for connecting corresponding repair cable conductors to opposite ends of said open conductors in said first and second termination areas, whereby the entire body of each of said open conductors may be maintained at the same electrical potential.

29. In a gas discharge display panel assembly having first and second closely spaced plates, an ionizable gas medium confined in a sealed area therebetween, and first and second arrays of parallel conductors arranged on said first and said second plates, respectively, apparatus for repairing an open conductor in said first array comprising:

first and second termination areas for said first array, each termination area including a plurality of repair pads, one end of each of said parallel conductors in said first array being connected to respective ones of said repair pads in said first termination area, and the opposite end of each of said parallel conductors in said first array being connected to respective ones of said repair pads in said second termination area, a repair cable conductor extending between said first and said second termination areas, and means for connecting said repair cable conductor to the repair pads in said first and said second termination areas, to which said open conductor is connected, whereby the entire body of said open conductor may be maintained at the same electrical potential.

30. The gas discharge display panel assembly of claim 29 wherein said repair cable is supported by said second plate, and further comprising double sided adhesive tape between said repair cable and said second plate for holding said repair cable against said second plate.

31. The gas discharge display panel assembly of claim 30 wherein said double sided adhesive tape is foam tape, for cushioning said repair cable as it is held against said second plate.

32. The gas discharge display panel assembly of claim 29 wherein said first termination area further includes a plurality of driver pads, one end of each of said parallel conductors in said first array being connected to respective ones of said driver pads.

33. The gas discharge display panel assembly of claim 29 wherein said repair cable comprises a polyester base, a layer of thermosetting adhesive on said base and a repair cable conductor partially embedded within said layer of theremosetting adhesive.

34. The gas discharge display panel assembly of claim 33 wherein said repair cable conductors comprise polyurethane insulated wires.

35. In a gas discharge display panel assembly having first and second closely spaced plates, an ionizable gas medium confined in a sealed area therebetween, and first and second arrays of parallel conductors arranged on said first and second plates, respectively, said arrays being disposed substantially orthogonal to each other, and the respective intersection of pairs of orthogonal conductors defining gaseous discharge cells, apparatus for repairing open conductors in said first array comprising:

first and second termination areas for said first array, each termination area including a plurality of linearly arranged repair pads, one end of each of said parallel conductors in said first array being connected to respective ones of said repair pads in said first termination area, and the opposite end of each of said parallel conductors in said first array being connected to respective ones of said repair pads in said second termination area, a first repair cable having a plurality of first repair cable conductors, extending from a point in said first termination area to one end of said first termination area, across said second plate on the outer surface thereof, to one end of said second termination area and to a point in said second termination area, means for connecting corresponding first repair cable conductors in said first termination area to respective repair pads associated with said one end of said open conductors between said point and said one end of said first termination area, and means for connecting corresponding first repair cable conductors in said second termination area to respective repair pads associated with said opposite end of said open conductors between said point and said one end of said second termination area, whereby the entire body of each of said open conductors between said point and said one end of said first termination area may be maintained at the same electrical potential.

36. The gas discharge display panel assembly of claim 35 further comprising:

a second repair cable having a plurality of second repair cable conductors extending from said point in said first termination area to the other end of said first termination area, across said second plate on the outer surface thereof to the other end of said second termination area and to said point in said second termination area, means for connecting corresponding second repair cable conductors in said first termination area to respective repair pads associated with said one end of said open conductors between said point and said other end of said first termination area, and means for connecting corresponding second repair cable conductors in said second termination area to respective repair pads associated with said opposite end of said open conductors between said point and said other end of said second termination area, whereby the entire body of each of said open conductors between said point and said other end of said first termination area may be maintained at the same electrical potential.

37. The gas discharge display panel assembly of claim 35 further comprising double sided adhesive tape between said first repair cable and said outer surface of said second plate, for holding said first repair cable against the outer surface of said second plate.

38. The gas discharge display panel assembly of claim 37 wherein said double sided adhesive tape is foam tape, for cushioning said first repair cable as it is held against the outer surface of said second plate.

39. The gas discharge display panel assembly of claim 35 wherein said first termination area further includes a plurality of driver pads, said one end of some of said parallel conductors in said first array being connected to respective ones of said driver pads in said first termination area, and said second termination area further includes a plurality of driver pads, said opposite end of the remainder of said parallel conductors in said first array being connected to respective ones of said driver pads in said second termination area.

40. The gas discharge display panel assembly of claim 35 wherein said first repair cable comprises a polyester base, a layer of thermosetting adhesive on said base and a plurality of first repair cable conductors partially embedded within said layer of thermosetting adhesive.

41. The gas discharge display panel assembly of claim 40 wherein said first repair cable conductors comprise polyurethane insulated wires.

* * * * *